United States Patent [19]

Carkhuff

[11] 4,209,096

[45] Jun. 24, 1980

[54] BLISTER CONTAINER HAVING A RECLOSABLE LID ASSEMBLY

[75] Inventor: Edwin D. Carkhuff, Dunedin, Fla.

[73] Assignee: Pharmacare, Inc., Largo, Fla.

[21] Appl. No.: 17,893

[22] Filed: Mar. 6, 1979

[51] Int. Cl.[2] ..... B65D 47/10

[52] U.S. Cl. ..... 206/621; 206/626; 206/484; 222/153; 222/541; 403/100

[58] Field of Search ..... 222/153, 541; 403/100, 403/102; 206/484, 461, 467, 469, 470, 621, 626, 806; 229/1.5, 45; 221/554

[56] References Cited

U.S. PATENT DOCUMENTS

| | | | |
|---|---|---|---|
| 2,172,930 | 9/1939 | Bensel | 206/621 |
| 3,437,199 | 4/1969 | Jacobson | 206/470 |
| 3,913,734 | 10/1975 | Siegel | 206/484 |

*Primary Examiner*—H. Grant Skaggs
*Attorney, Agent, or Firm*—H. P. Settle

[57] ABSTRACT

A blister type container of the type generally intended for a single dispensing use, the container having a reclosable, securable lid which reinforces the container against accidental dispensing of the contents both before and after an initial use. The invention comprises a blister container including a nozzle portion having a frangible segment for forming a nozzle opening and a lid, wherein the nozzle portion is surrounded by an integrally formed flange member sealingly engaged to a flexible backing strip and having (1) a transverse weakened segment aligned with the frangible segment of the nozzle portion for forming a finger tab for facilitating the breaking of the frangible nozzle segment; and (2) an arcuate cross section in the vicinity of the transverse, weakened segment which cooperates with the flexible backing strip to exert a sealing force on the lid when the lid is placed over the nozzle opening. A substantially flat, rigid element is pivotally connected on a point on the flange for pivotal movement into either a (i) lid securing position for rigidifying the transverse weakened segment of the flange and securing the lid over the nozzle opening; or (ii) a lid opening position away from the transverse weakened segment. When the pivotal element is pivotally connected onto the finger tab portion of the tab, it operates to extend the length of the tab, thereby facilitating the exertion of a shear opening force on the frangible segment of the nozzle portion of the container during an initial use.

19 Claims, 6 Drawing Figures

BLISTER CONTAINER HAVING A RECLOSABLE LID ASSEMBLY

BACKGROUND OF THE INVENTION

Snap-open blister type containers have become an increasingly popular solution to a variety of packaging problems. Such containers are an excellent means for distributing samples of medicines, foodstuffs, or cosmetics as they are extremely lightweight, cheaply mailable, extremely inexpensive to manufacture, and yet are effective in securing and dispensing their contents. Such containers also provide a good means for stores to display and advertise the substance contained within. The broad, flat bubble forming the blister compartment of the container is easily air plug assist fabricated from a transparent plus coloured plastic sheet material well suited to display the contents of the container, while the broad, flat flange element typically formed around the blister compartment is readily secured to a cardboard display card easily hung on a display rack.

However, snap-open blister containers have, up to now, been limited to single use or throw-away containers, since they suffer from one distinct disadvantage—that of securely re-sealing the lid once it has been opened. One of the least expensive and most effective of the prior art solutions to this problem is the invention set forth in the disclosure of the Siegal U.S. Pat. No. 3,913,734. Here, the reclosability problem is solved by forming the backing member of the blister container from a sheet material having a mechanical "memory", and providing the portion of the flange surrounding the nozzle with a transverse weakened segment which is aligned with the frangible segment of the nozzle. Thus, when the transverse weakened segment of the flange folded back to break the frangible segment of the nozzle to form a nozzle opening, a hinge type structure is formed along the fold which seeks to re-align itself back into the substantially flat orientation it "remembers", thereby sealingly rejoining the nozzle lid back over the nozzle opening. Another embodiment of the invention disclosed in the Siegal patent comprises all the features of the previously described closure assembly, with the addition of providing the flange in the vicinity of the transverse weakened section with an arcuate cross section. The arcuate shape of this cross section cooperates with the flexible backing sheet sealingly engaged to the flange to provide an over center force tending to "pop" the lid over the nozzle opening when the hinge dividing the flange is close to resuming the flat, 180° alignment it "remembers".

The weakness of the Siegal invention is the fact that once the blister container disclosed therein is opened, any relatively small shear force applied across the "hinge" will break the seal and reopen the container, which could result in spillage or leakage of the contents. Accordingly, there exists a need for a snap-open blister container with a lid which is not only re-sealable, but also readily securable once it is closed over the nozzle opening.

SUMMARY OF THE INVENTION

The invention relates to a snap-open blister container having a reclosable, securable lid assembly. The blister container of the invention is basically comprised of two components, including a blister compartment or body having an integrally formed flange which is sealingly adhered to a flexible backing strip and a closure means pivotally mounted on the flange of the blister compartment.

At one end, the blister compartment of the container tapers into a hollow, closed, integrally formed nozzle portion, which is transversed by a weakened, frangible segment which divides the closed nozzle into a nozzle opening having a hingedly movable, mating nozzle cap when a predetermined shear force is exerted on the segment by folding back the flange across the segment.

The flange element surrounding the nozzle portion of the blister compartment is characterized by a transverse, weakened scoreline or bend line aligned with the weakened, frangible segment dividing the nozzle portion. This scoreline defines a finger tab out of the portion of the flange located above the nozzle opening which facilitates the application of a shear force on the frangible segment of the closed nipple on top of the nozzle. Additionally, the cross section of the flange in the vicinity of the weakened scoreline may be transversely arcuate, or "bowed" relative to the longitudinal axis of the tapered nozzle. This bowed shape of the flange cooperates with the segment of the flexible backing strip or sheet sealingly engaged to the flange in the vicinity of the weakened scoreline traversing the flange to generate an over center closing force on the cap when the hinge formed at the scoreline is straightened to place the cap over the nozzle opening, as will be described more fully hereafter.

The closure or cap securing means of the blister container is formed from a substantially flat, rigid element having a face adjacent to one or both of the faces of the flange, and is pivotally mounted on a point on the flange of the blister container preferably in the vicinity of the finger tab. The cap securing means is pivotally slidable into either (1) a cap securing position across the transverse scoreline, thereby rigidifying the flange across the hinge joining the finger tab to the rest of the flange; or (2) a cap opening position away from the transverse scoreline and contiguous with the finger tab. When the cap securing means is pivotally mounted on the finger tab portion of the tab and slided into the cap opening position, the length of the finger tab is extended, thereby increasing the leverage associated with it and facilitating the application of a shear opening force on the frangible segment of the nozzle.

BRIEF DESCRIPTION OF THE DRAWINGS

Finally.

DETAILED DESCRIPTION OF THE DRAWINGS

Figure 1:
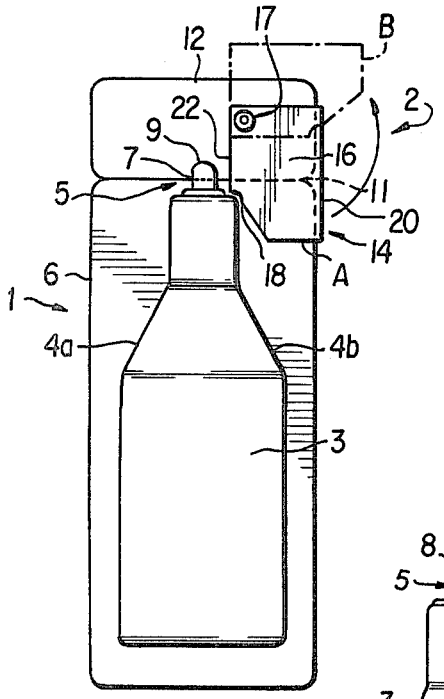
FIG. 1 is a front, plane view of one embodiment of the re-closable blister container of the invention.

With reference to FIG. 1, the invention generally comprises a "snap-open" blister container 1 having a reclosable cap assembly 2. The blister container 1 includes a blister compartment 3 having a nozzle portion generally indicated at 5. The blister compartment as illustrated is circumscribed at all points along its edge by an integrally formed flange 6; however, the only portion of the flange necessary for the proper functioning of the invention is the portion of the flange above the tapered shoulders 4*a* and 4*b* of the blister compartment 3. The blister compartment 3 and flange 6 are preferably vacuum formed from a resilient, lightweight sheet of transparent heat fusible plastic, and flange 6 heat sealed to flexible backing member 21 to form a blister container which is transparent, and thereby well adapted to display the contents of the container for advertising purposes, as well as lightweight, and thereby well suited as an inexpensive mailer container for samples. Of course, any type of blister container having the mechanical equivalent of a snap-open type nozzle circumscribed by a flange is encompassed within the scope of the invention.

Figure 2:
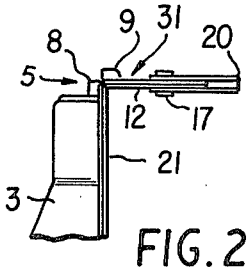
FIG. 2 is a detailed side view of the nozzle portion of the container of the invention.

Referring now to FIGS. 1 and 2 together, the nozzle portion 5 of blister compartment 6 includes a transversely disposed, frangible segment 7 which is breakable to form a nozzle opening 8 and a nozzle cap 9 when a shear force is applied to it, as will herein be described in detail. Flange 6 includes a bend line in the form of a transverse weakened segment 11 which is aligned with the frangible segment 6 of the nozzle portion. The transverse weakened segment 11 may be formed from either a continuous linear cut penetrating halfway through the flange 6, or an intermittent, "scoreline" type cut as illustrated in FIG. 1. Segment 11 performs three distinct functions. First, it defines a "finger tab" 12 out of the upper portion of flange 6 for facilitating the manual application of a shear force on frangible segment 7 of the nozzle portion 5. Second, it focuses this manually applied shear force directly onto frangible segment 7 of the nozzle portion 5. Third, it provides a bend line across flexible backing strip 21 for forming a "hinge" structure between the finger tab 12 and the rest of flange 6 after frangible segment 7 is broken, which hingedly connects nozzle opening 8 with mating cap 9. This last function, in turn, allows the blister container to be resealed by straightening the finger tab 12 away from the bent position in FIG. 2 back toward the flat alignment illustrated in FIG. 1, to place the mating cap 9 back into its original position over nozzle opening 8 in sealing engagement.

Figure 3:
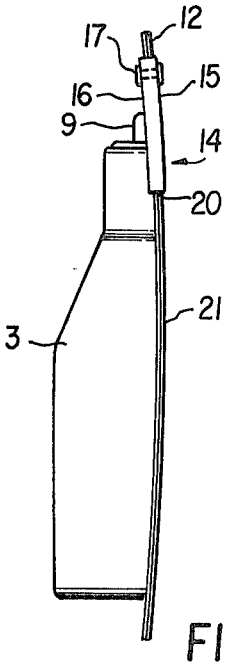
FIG. 3 is a side view of the container shown in FIG. 1.

Referring now to FIGS. 1 and 3, in order to secure cap 9 over nozzle 8 after frangible segment 7 is broken, the finger tab 12 of flange 6 is provided with a cap securing means 14 which is pivotally mounted on the upper portion of finger tab 12. Cap securing means 14 may be formed from a rectangular section of stiff, foldable plastic sheet material centrally folded to form a pair of opposing lock tabs 15, 16 in a "U" shaped configuration having a closed edge 20 formed by the fold and an open edge 22 opposite the closed edge 20 for receiving a portion of flange 6 on both sides of the transverse weakened scoreline 11 when the cap securing means is in position "A". In this embodiment, the cap securing means 14 is pivotally mounted on the finger tab portion 12 of flange 6 by means of a round, open rivet 17, although any type of pivotal mounting is within the scope of the invention. However, the use of rivet 17 has the advantage of providing a ready made, reinforced aperture which may be used to receive a prong of a display assembly.

It should be noted at this point that the cap securing means 14 of the invention does not necessarily have to be pivotally mounted on the finger tab portion 12 of flange 6, and may also be mounted on the portion of flange 6 below scoreline 11. However, it is preferred that the cap securing means be pivotally mounted on finger tab portion 12 as illustrated for reasons hereafter stated.

Cap securing means 14 is pivotally slidable into either cap securing position A or a cap opening position B, as shown in FIG. 1.

In cap securing position A, both of the lock tabs 15, 16 bridge across transverse scoreline 11 such that tab 15 flush against the front face of flange 6 and tab 16 flush against the outside face of the flexible backing strip 21. The closed edge 20 connecting the two locking tabs 15, 16 is pivotally slided toward the blister compartment 3 of the container 1 so that the fold forming closed edge 20 abuts an edge of flange 6 in the vicinity of transverse scoreline 11 and notch 18 of tab 16 receives an edge of the blister compartment 3 in the vicinity of nozzle portion 5 as shown. Such positioning of the cap securing means 14 imparts maximum strength to the portion of flange 6 surrounding the transverse weakened scoreline 11 by maximizing the amount of surface area of flange 6 received between the opposing lock tabs 15, 16. It should be noted that notch 18 serves to strengthen this arrangement by allowing front tab 16 of the cap securing means 14 to engage flange 6 around the vicinity of transverse scoreline 11 with more surface area than would otherwise be possible without such a notch.

In cap opening position B, cap securing means 14 is pivotally slided 90° away from transverse scoreline 11 of flange 6 as shown in FIG. 1, thereby completely disengaging it from its reinforcing position across scoreline 11. When cap securing means 14 is pivotally mounted on the finger tab portion 12 of the flange 6, rather than the portion of the flange 6 below scoreline 11, it operates in cap opening position B to extend the length of finger tab 12, thereby increasing the leverage associated with the tab and making it easier to manually exert a shear force on frangible segment 7 of nozzle portion 5.

Figure 4:
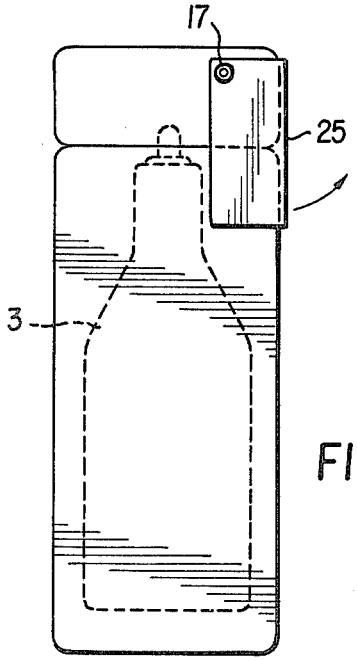
FIG. 4 is a back view of an alternative embodiment of the invention showing the cap securing means mounted adjacent to the flexible backing strip.
Figure 5:
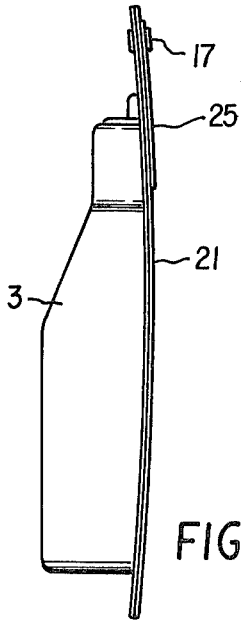
FIG. 5 is a side of the alternative embodiment of the invention illustrated in FIG. 4.

FIGS. 4 and 5 illustrate an alternative embodiment of the cap securing means of the invention. Here, a single lock tab 25 pivotally mounted on the back of finger tab 12 is employed instead of the folded dual tab structure illustrated in FIGS. 1 and 3. Although some structural strength is sacrificed by eliminating the front tab, two important advantages are gained. First, being structurally simpler, this embodiment is less expensive to manufacture. Secondly, the pivotal motion of this simpler embodiment is not confined by the fold structure at 20 to a pivotal rotation of approximately 90°; hence, the single lock tab 25 may be rotated 180°, thereby affording a maximum extension of finger tab 14.

Figure 6:
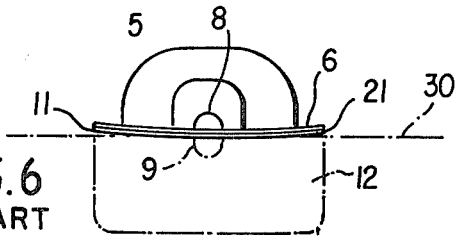
FIG. 6 PRIOR ART
FIG. 6 is a top view of a type of blister container which may be used with the invention having a flange with an arcuate cross section.

FIG. 6 illustrates a top view of a type of blister container which may be used with the invention having a flange with an arcuate or "bowed" cross section around the vicinity of transverse weakened scoreline 11. This feature cooperates with the flexibility of flexible backing strip 21 to provide still another cap securing force on cap 9, as will now be explained.

Because flange 6 is preferably formed from a resilient sheet, the bowed, arcuate portion of flange 6 in the vicinity of weakened scoreline 11 will always seek to resume this bowed, arcuate shape due to the resiliency of the sheet material forming flange 6. When finger tab 12 is bent over to form a hinge between the finger tab 12 and the rest of flange 6, the arcuate cross section of flange 6 is straightened flat along dotted line 30, as illustrated in FIG. 6. Thus, when finger tab 12 is straightened back into near alignment with the rest of flange 6, the resiliency of the flange in the vicinity of scoreline 11 exerts an "over center" type force on the tab causing it to "pop" back into its arcuate shape and initial alignment with the rest of flange 6, thereby sealingly re-engaging cap 9 over nozzle opening 8.

Still another cap securing force may be called into play if flexiable backing strip 21 is formed from a sheet material having a memory, in addition to being flexible. In this case, when finger tab 12 is bent over, the portion of backing strip 21 adjacent to flange 6 in the vicinity of weakened scoreline 11 will exert a positive closing force on finger tab 12 as it seeks to resume the straight alighment it "remembers", as indicated by vector 31 in FIG. 2. This backing strip realignment force, in combination with the "over center" force generated by the bowed cross section of flange 6 around the vicinity of scoreline 11 and the dual or single tab lid securing means, provides an improved, reclosable blister container which is both resealable, and securable in the resealable condition.

It is obvious that numerous changes may be made in the embodiments described above without departing from the scope of the invention.

Now that the invention has been described, what is claimed is:

1. A blister container assembly having a reclosable nozzle, comprising:

a blister compartment having a nozzle portion including a frangible segment for dividing said nozzle portion into a nozzle opening and a nozzle cap when said frangible segment is broken by the application of a predetermined shear force thereon; a flange integrally formed with and extending completely around said blister compartment a backing sheet having a front face secured to and extending completely around said blister compartment, said sheet further having: a transverse scoreline aligned with said frangible segment of said nozzle portion of said blister compartment for defining a finger tab portion on said flange for facilitating the manual exertion of said predetermined shear force on said frangible segment of said nozzle portion in order to selectively break said segment, and a lid securing means including a substantially flat, rigid element having a face abutting the back face of said sheet and pivotally mounted on said sheet for pivotal movement into: a lid securing position across said transverse scoreline and contiguous with both said finger tab portion of said flange and the rest of said flange for resisting any shear force tending to separate said lid from said opening of said nozzle, and a lid opening position away from said transverse scoreline, whereby said lid securing means does not interfere with the bending of said transverse scoreline across said backing sheet.

2. The blister container of claim 1 wherein said lid securing means is pivotally mounted on said finger tab portion of said flange for extending the length of said finger tab portion when pivoted into said lid opening position, thereby facilitating the application of a shear opening force on said frangible segment of said nozzle portion.

3. The blister container of claim 1 or 2 wherein said substantially flat, rigid element of said lid securing means is comprised of a section of stiff, foldable sheet material centrally folded to form a pair of opposing lock tabs integrally connected along a closed edge formed by said fold, and having an open edge opposite said fold for receiving a portion of said flange on both sides of said scoreline between said opposing lock tabs when said lid securing means is slidably pivoted into said lid securing position.

4. The blister container assembly of claim 3 wherein said lock tab adjacent said side of said flange facing said blister compartment includes a notch for receiving an edge of said blister compartment in the vicinity of said nozzle portion of said container when said pair of lock tabs of said lid securing means is pivotally slided into said lid securing position to such an extent that said fold integrally connecting said tabs abuts the edge of said flange.

5. The blister container assembly of claim 4 wherein said pair of opposing lock tabs are pivotally mounted on said flange by means of a rivet.

6. The blister container assembly of claim 5 wherein said rivet comprises an open rivet for providing an aperture in said blister container assembly for receiving the prong of a display rack.

7. The blister container assembly of claim 2 wherein said substantially flat rigid element of said lid securing means is comprised of a portion of stiff sheet material pivotally mounted against said flexible backing strip on said finger tab portion of said flange.

8. The blister container assembly of claim 7 wherein said portion of stiff sheet material comprising said flat, rigid element of said lid securing means is a rectangular section of plastic material.

9. The blister container assembly of claim 8 wherein said rectangular section of plastic material is pivotally mounted by means of a rivet.

10. The blister container assembly of claim 9 wherein said rivet comprises an open rivet for providing an aperture in said blister container assembly for receiving the prong of a display rack.

11. The blister container assembly of claim 1 wherein said flexible backing strip is formed from a resilient sheet material for providing a closing force on said finger tab.

12. A blister container assembly having a reclosable nozzle, comprising:

a flexible backing strip;

a blister compartment having a nozzle portion, including a frangible segment for dividing said nozzle portion into a nozzle opening and a nozzle lid when said frangible segment is broken by the application of a predetermined shear force thereon;

a flange integrally formed from and extending completely around said blister compartment, said flange being sealingly engaged to said flexible backing strip to form a blister container, said flange further having: a linear transverse weakened portion aligned with said frangible segment of said nozzle portion of said blister compartment for both defining a finger tab portion for facilitating the manual exertion of a shear force on said frangible segment, and for focusing said shear force on said segment to break said segment;

said container having an arcuate cross-section in the area of said linear, transverse weakened portion for exerting a closing force on said lid whenever said finger tab portion is aligned with the rest of said flange to place said lid over said opening of said nozzle portion;

and a lid securing means including a section of stiff, foldable sheet material centrally folded to form a pair of opposing lock tabs having a closed edge formed by said fold, and an open edge opposite said fold for receiving a portion of said flange on both sides of said linear weakened portion between said opposing lock tabs, said lid securing means further being pivotally mounted on a point on said finger tab portion of said flange and pivotally slidable about said point into: a lid securing position across said linear, transverse scoreline for receiving a portion of said flange on either side of said linear weakened portion for resisting any shear force tending to separate said lid from said opening of said nozzle; and a lid opening position away from said linear, transverse scoreline for receiving said finger tab portion of said flange only and for extending the length of said finger tab portion for further facilitating the application of said shear force on said lid.

13. The blister container assembly of claim 11 wherein said foldable sheet material forming said opposing lock tabs is plastic.

14. The blister container assembly of claim 11 wherein said lock tabs are pivotally mounted at one end on said finger tab portion of said flange by means of a rivet.

15. The blister container assembly of claim 14 wherein said rivet comprises an open rivet for providing an aperture in said blister container assembly for receiving the prong of a display rack.

16. The blister container assembly of claim 11 wherein said flexible backing strip is formed from a resilient sheet material for providing a closing force on said finger tab.

17. In combination, a blister type container comprising a backing sheet and a blister adhered to the front surface thereof to cooperably define a product enclosure communicating with a nozzle which is rupturable when the backing sheet is bent in one direction toward the back surface of the sheet and along a predetermined bend line, and a separate reinforcing member normally positioned to engage said backing sheet on the back surface thereof to bridge said predetermined bend line, thereby preventing rupture of said nozzle or the dispensing of product through said nozzle, and said member being movable relative to the backing sheet to engage said sheet solely on one side of said bend line, thereby accommodating rupture of said nozzle or dispensing of product through the nozzle upon bending of said backing sheet.

18. In a blister type container wherein a bendable backing sheet has adhered to one face, a blister defining a product containing body portion and a dispensing nozzle portion which is weakened for rupture when the backing sheet portion surrounding the nozzle is bent, thereby permitting the dispensing of product through said ruptured nozzle portion, the improvement of a substantially rigid reinforcing element pivoted to the backing sheet and in contact therewith to normally bridge that portion of the backing sheet which is bent to rupture the nozzle portion of the blister, said element when in its normal position preventing bending of the sheet, and said element being pivotally movable relative to the backing sheet to permit such bending.

19. In a blister type container generally intended for dispensing its contents in a single use, the container comprising a backing sheet having a support and a dispensing portion joined along a designated bend line and a blister adhered to one face of said sheet and including a product containing body portion and a dispensing nozzle portion weakened in alignment with said bend line to rupture when the backing sheet is bent in one direction, the improvement of a substantially rigid closure element, and means for movably securing said element to said backing sheet in spaced relation to said bend line, said element having a generally planar portion projecting from the securing means to bridge the bend line on that side of said sheet toward which the backing sheet is bent to rupture said nozzle portion, and said element being movable relative to said backing sheet so that said element does not bridge said bend line, thereby accommodating bending of said sheet for dispensing of the container contents through the ruptured nozzle portion.

* * * * *